US010584849B2

(12) United States Patent
Liu et al.

(10) Patent No.: US 10,584,849 B2
(45) Date of Patent: Mar. 10, 2020

(54) LIGHTING DEVICE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Yen-Hung Liu, Taipei (TW); Po-Chang Li, Taipei (TW)

(73) Assignees: LITE-ON ELECTRONICS (GUANGZHOU) LIMITED, Guangzhou (CN); LITE-ON TECHNOLOGY CORPORATION, Neihu (TW)

( * ) Notice: Subject to any disclaimer, the term of this patent is extended or adjusted under 35 U.S.C. 154(b) by 0 days.

(21) Appl. No.: 16/168,867

(22) Filed: Oct. 24, 2018

(65) Prior Publication Data

US 2019/0383466 A1 Dec. 19, 2019

(30) Foreign Application Priority Data

Jun. 15, 2018 (CN) ..... 2018 1 0622315

(51) Int. Cl.

| | |
|---|---|
| ***F21V 7/00*** | (2006.01) |
| ***F21V 7/28*** | (2018.01) |
| ***F21V 7/10*** | (2006.01) |
| ***F21S 8/08*** | (2006.01) |
| *F21W 131/103* | (2006.01) |
| *F21Y 115/10* | (2016.01) |

(52) U.S. Cl.

CPC ..... *F21V 7/0008* (2013.01); *F21S 8/085* (2013.01); *F21V 7/10* (2013.01); *F21V 7/28* (2018.02); *F21W 2131/103* (2013.01); *F21Y 2115/10* (2016.08)

(58) Field of Classification Search

CPC ..... F21V 7/0008; F21V 7/28; F21V 7/0025; F21V 7/0016; F21S 8/085

See application file for complete search history.

(56) References Cited

U.S. PATENT DOCUMENTS

2007/0024191 A1* 2/2007 Chen ..... H01L 33/507 313/512

* cited by examiner

*Primary Examiner* — Anne M Hines

(74) *Attorney, Agent, or Firm* — McClure, Qualey & Rodack, LLP

(57) ABSTRACT

A lighting device including a lamp and a reflector is provided. The reflector is located in a light emitting direction of the lamp and disposed farther away from the lamp for reflecting a light emitted from the lamp. The reflector includes at least one reflective sheet and a coating partially formed on the at least one reflective sheet.

18 Claims, 5 Drawing Sheets

LIGHTING DEVICE

This application claims the benefit of People's Republic of China application Serial No. 201810622315.8, filed Jun. 15, 2018, the subject matter of which is incorporated herein by reference.

BACKGROUND OF THE INVENTION

Field of the Invention

The invention relates in general to a lighting device, and more particularly to a lighting device with a reflector.

Description of the Related Art

For the lighting devices used in night-time illumination, such as street lights, wall lights or outdoor searchlights, different illumination effects can be provided, and the manufacturers normally need to develop additional molds for the optical elements, such as curved or other shaped optical elements, to produce different lighting patterns, and therefore the manufacturing cost is high.

Besides, the street lights which provide illumination to the streets may provide different illumination in response to different road conditions. For example, the lighting devices for highways, expressways, motorways, bicycle ways, sidewalks, and amusement park facilities may need to adjust the lighting pattern according to the quantity, region or use of the lighting devices and road conditions to meet market needs.

Therefore, how to provide a lighting device capable of adjusting illumination conditions to meet market needs without increasing manufacturing cost has become a prominent task for the industries.

SUMMARY OF THE INVENTION

The invention relates to a lighting device equipped with a reflector capable of adjusting illumination conditions to produce different illumination effect.

According to one embodiment the present invention, a lighting device including a lamp and a reflector is provided. The reflector is located in a light emitting direction of the lamp away from the lamp for reflecting a light emitted from the lamp. The reflector includes at least one reflective sheet and a coating partially formed on the at least one reflective sheet.

The lighting device disclosed in embodiments of the invention includes a reflector whose surface has a coating partially formed on the reflector according to the illumination conditions. The coating can adjust the lighting pattern of the lamp according to the road conditions to meet market needs. Meanwhile, the lighting device of the embodiment can adjust the lighting pattern without using optical elements, hence saving the mold cost for the optical elements and reducing the manufacturing cost.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements.

The lighting device 100 according to an embodiment of the invention includes a lamp 110 and a reflector 120, The reflector 120 is located in a light emitting direction of the lamp 110 and disposed farther away from the lamp 110 for reflecting a light L emitted from the lamp 110.

Figure 1:
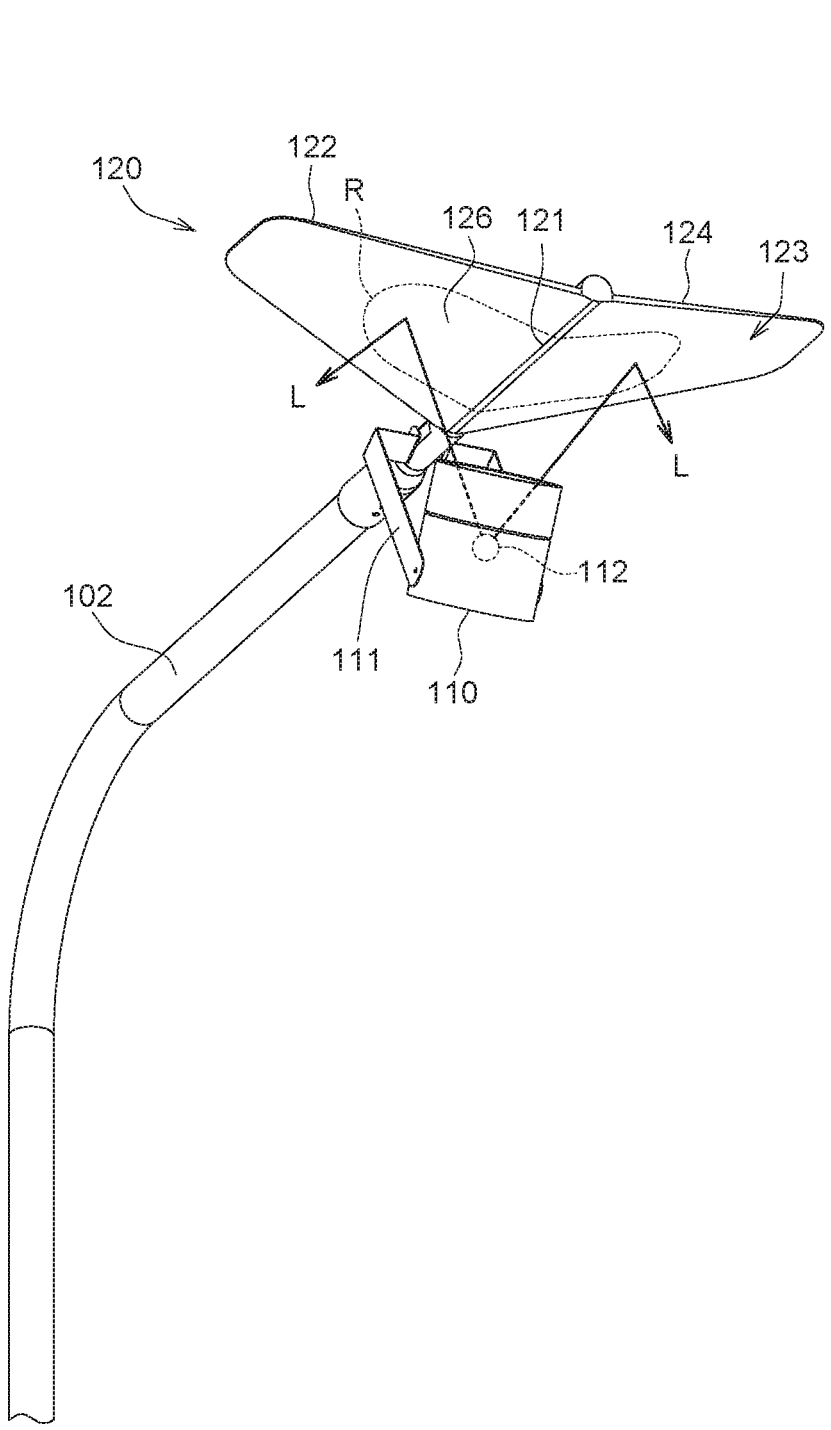
FIG. 1 is a schematic diagram of a lighting device according to an embodiment of the invention, wherein the lighting device is located on a supporting member.

Refer to FIG. 1. The lighting device 100 according to an embodiment of the invention may further include a supporting member 102 on which the reflector 120 and the lamp 110 are disposed via the shaft 121 and the frame 111, respectively. The lamp 110 and the frame 111 are pivotally connected to each other, such that both the reflector 120 and the lamp 110 can be disposed on the supporting member 102. The supporting member 102 can be realized by such as a lamp post or a lamp stand. Meanwhile, the lighting device 100 can be connected to an external power source via wires in the supporting member 102.

In an embodiment, the lighting device 100 can be disposed above a spot where illumination is required to form an indirect illumination or a night landscape illumination. Examples of the said spot include lane divider islands, sidewalks, subways, railway platforms, runways, or the surrounding of a park or a building. The indirect illumination refers to the illumination in which the light-emitting surface of the lamp 110 faces upward, and the light L is reflected by the reflector 120 to form an illumination area on the ground. The indirect illumination makes the light uniformly distributed and avoids the light being directly irradiated on the eyes and causing glare. Particularly, in the night time or at the spot where the ambient light is insufficient, it is better to avoid the human eyes being directly irradiated by the light L. Therefore, in the present embodiment, the lighting device 100 adopts an indirect illumination, in which the light-emitting surface of the lamp 110 faces upward, and the lamp 110 is located under the reflector 120.

The lighting device 100 adopting an indirect illumination can further be used as a night-time landscaping illumination to increase the design aesthetics of the lamp 110. In an embodiment, the appearance of the reflector 120 can be adjusted according to local landscaping. The appearance of the reflector 120 can be designed according to the illumination conditions (such as lighting pattern) required for the local environment or the roads, and therefore is not restricted in the invention.

In the present embodiment, the appearance of the reflector 120 is wing-shaped. In other embodiments, the reflector 120 can be a planar surface, a curved surface, a polygonal surface, an arced surface or a patterned surface. The reflector 120 can be formed of one, two or multiple plates, and the invention is not limited thereto.

To avoid the light L of the lamp 110 projected to the reflector 120 being focused at a particular spot and generating glare, the lamp 110 can have a tapered lighting pattern, such that the light L can be emitted via a larger light-emitting angle. In an embodiment, a lens (not illustrated) is installed on the light-emitting surface of the lamp 110 for the light L, such that the light L will be diverged and will not be focused at a particular spot.

In another embodiment, to avoid the light L of the lamp 110 projected to the reflector 120 being focused at a particular spot and generating glare, the reflector 120 can have a curved surface or a bevel for reflecting the light L, such that the light L will be diverged and will not be focused at a particular spot.

In an embodiment, the reflector 120 includes at least one reflective sheet and a coating 126 partially formed on at least one reflective sheet. That is, the reflector 120 can be formed of one, two or multiple plates. For the convenience of description, the reflector 120 is exemplified by two reflective sheets in following embodiments. The angle between the two reflective sheets can be adjusted according to the required lighting pattern, such that a diversity of illumination effect can be provided.

Refer to FIG. 1. The lamp 110 is disposed under the reflector 120 and has a tapered light source 112, such as a light-emitting diode (LED) element. The light source 112 emits a light L to the surface of the reflector 120 from the emission center to form an irradiation area R (represented by dotted lines). The irradiation area R substantially corresponds to the light-emitting angle of the light source 112, and the larger the light-emitting angle of the light source 112, the larger the irradiation area R. Conversely, the smaller the light-emitting angle of the light source 112, the smaller the irradiation area R.

Also, the surface 123 of the reflector 120 has a coating 126 correspondingly located within the irradiation area R of the tapered light source 112. That is, the coating 126 is partially formed on the first reflective sheet 122 and/or the second reflective sheet 124.

In an embodiment, the first reflective sheet 122 and the second reflective sheet 124 are formed by an opaque material, such as plastics, a metal or a material with black or dark color. The coating 126 can have a reflectivity different from that of the first reflective sheet 122 and the second reflective sheet 124, and can be formed on the surface by way of coating, attaching, hot pressing, or gluing.

Preferably, when the coating 126 is correspondingly located within the irradiation area R of the tapered light source 112, the coating 126 can be formed of a material with high reflectivity, and the first reflective sheet 122 and the second reflective sheet 124 can be formed by a material with low reflectivity, such that the reflectivity of the first reflective sheet 122 and the second reflective sheet 124 can be smaller than that of the coating 126. For example, the coating 126 has a reflectivity larger than 90% or above, the first reflective sheet 122 and the second reflective sheet 124 have a reflectivity smaller than 80% or below. The coating 126 can be formed by a material with high reflectivity such as resin or a compound. The coating 126 can be sprayed on a reflective sheet, and the spraying method is not limited to liquid spraying or powder spraying.

Conversely, when the coating 126 is not located within the irradiation area R of the tapered light source 112 (that is, the coating 126 surrounds the irradiation area R), the coating 126 can be formed by a material with low reflectivity, and the first reflective sheet 122 and the second reflective sheet 124 can be formed by a material with high reflectivity, such that the reflectivity of the first reflective sheet 122 and the second reflective sheet 124 can be larger than that of the coating 126. For example, the first reflective sheet 122 and the second reflective sheet 124 have a reflectivity larger than 90% or above, the coating 126 has a reflectivity smaller than 80% or below.

In the present embodiment, the coating 126 is not necessarily located on both the first reflective sheet 122 and the second reflective sheet 124, and can be located on only one of them. When the coating 126 is located on the first reflective sheet 122, the coating 126 can adjust the lighting pattern formed by the light L reflected via the first reflective sheet 122. When the coating 126 is located on the second reflective sheet 124, the coating 126 can adjust the lighting pattern formed by the light L reflected via the second reflective sheet 124.

In an embodiment, the coating 126 is formed by a white lacquer, such as a glossy white lacquer with high reflectivity. The irradiation area R coated with white lacquer has a higher reflectivity, and the surrounding area of the irradiation area R is not coated with white lacquer and therefore has a lower reflectivity. In another embodiment, the coating 126 is formed by a non-white lacquer, and can be coated on the surrounding of the irradiation area R. Therefore, the coating area of the coating 126 can be changed to match the change in illumination conditions.

Figure 2A:
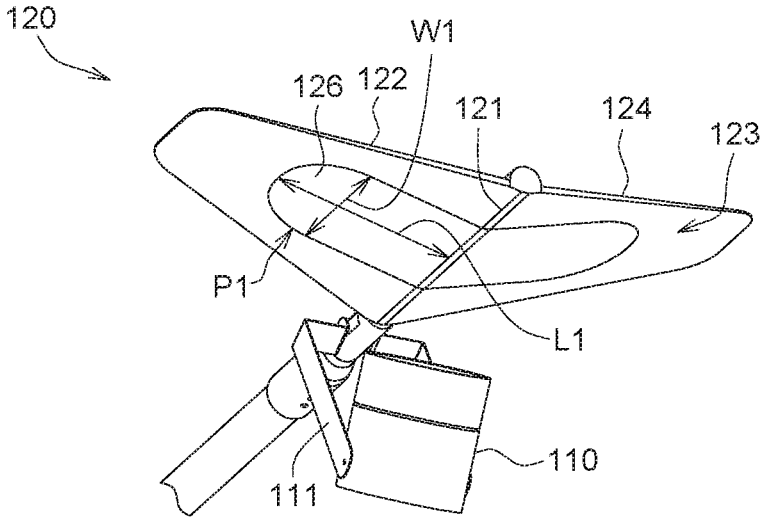
FIG. 2A is a schematic diagram of a lighting device according to an embodiment of the invention, wherein the reflective sheet has a coating with a first shape.
Figure 3A:
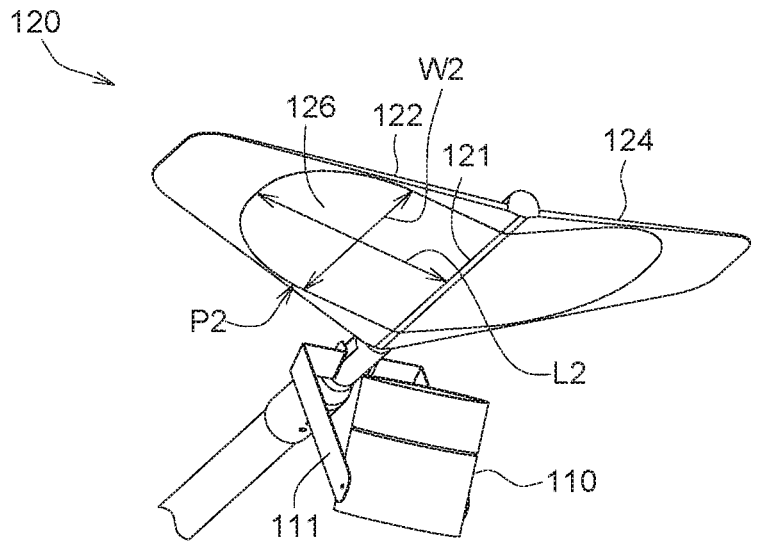
FIG. 3A is a schematic diagram of a lighting device according to another embodiment of the invention, wherein reflective sheet has a coating with a second shape.

Refer to FIG. 2A and FIG. 3A. The coating 126 has a first shape P1 and a second shape P2, respectively. Each of the first shape P1 and the second shape P2 can be a long strip, a widened long strip or any other shapes. Let the long strip be taken for example. In FIG. 2A, the coating 126 has a first length L1 in a direction perpendicular to the shaft 121. In FIG. 3A, the coating 126 has a second length L2 in a direction perpendicular to the shaft 121. The first length L1 is smaller than or equivalent to the second length L2, but the invention is not limited thereto. Or, in FIG. 2A, the coating 126 has a first width W1 in a direction parallel to the shaft 121. In FIG. 3A, the coating 126 has a second width W2 in a direction parallel to the shaft 121. The first width W1 is smaller than or equivalent to the second width W2, but the invention is not limited thereto. When the light L is irradiated on the coating 126 having different shapes, the light L reflected via the coating 126 forms a lighting pattern corresponding to the shape of the coating 126, such that different illumination effects can be provided.

Figure 2B:
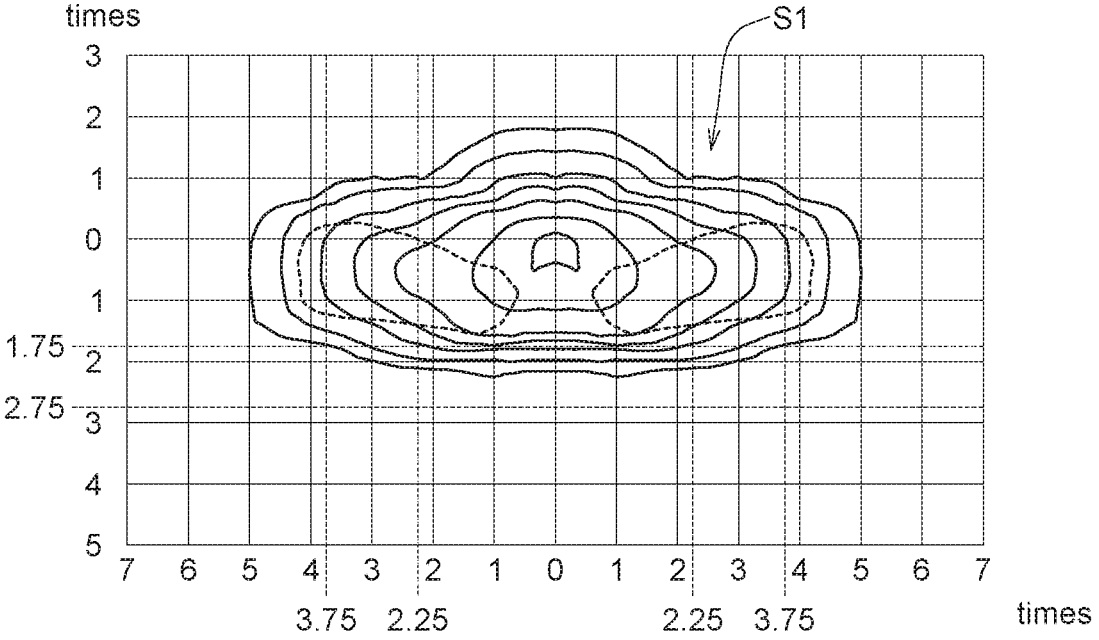
FIG. 2B is a contour diagram of a lighting pattern of the lighting device of FIG. 2A.
Figure 3B:
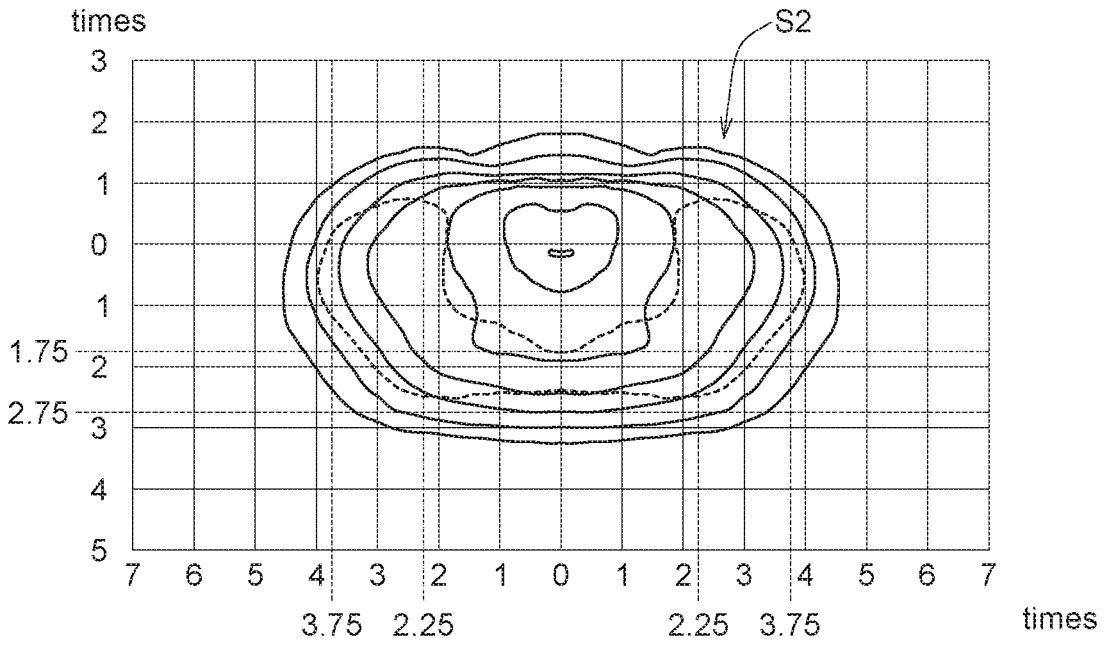
FIG. 3B is a contour diagram of a lighting pattern of the lighting device of FIG. 3A.

Refer to FIGS. 2B and 3B. FIG. 2B is a contour diagram of lighting pattern S1 corresponding to the coating 126 having the first shape P1 as indicated in FIG. 2A. FIG. 3B is a contour diagram of lighting pattern S2 corresponding to the coating 126 having the second shape P2 as indicated in FIG. 3A. As indicated in FIG. 2B, the contour diagram is long and narrow, and 50% of the light intensity of the lamp marked by dotted lines are within 1.75 times of the installation height of the lamp along the vertical axis to generate an elliptical lighting pattern. Refer to the contour diagram of FIG. 3B, 50% of the light intensity of the lamp marked by dotted lines are within 1.75-2.75 times of the installation height of the lamp along the vertical axis to generate an elliptical lighting pattern. The short axis of the elliptical lighting pattern of FIG. 2B is shorter than that of FIG. 3B.

In another embodiment, the coating 126 can be formed by a non-white lacquer or a multi-color lacquer, such that the color of the illumination area can be changed.

Figure 4:
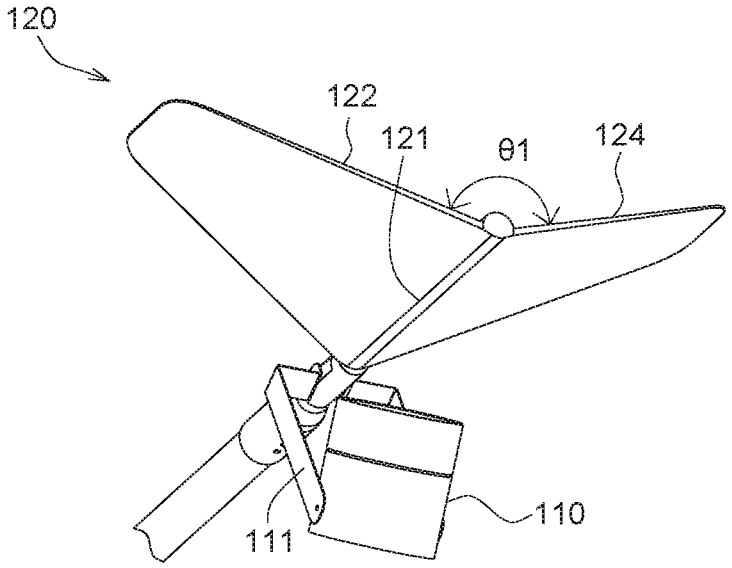
FIG. 4 is a schematic diagram of a lighting device according to an embodiment of the invention, wherein the first reflective sheet and the second reflective sheet are rotatably disposed on a shaft.
Figure 5:
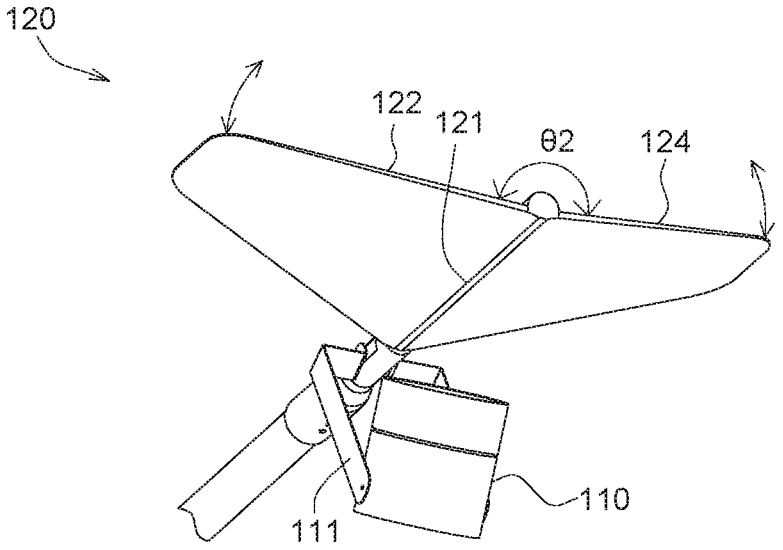
FIG. 5 is a schematic diagram of a lighting device according to an embodiment of the invention, wherein the first reflective sheet and the second reflective sheet respectively are rotatably disposed on a shaft.

Refer to FIG. 4 and FIG. 5. The reflector 120 further includes a shaft 121 on which the first reflective sheet 122 or the second reflective sheet 124 is rotatably disposed. That is, the reflector 120 can be rotated for an angle according to the illumination requirements, so that the first reflective sheet 122 and the second reflective sheet 124 can form a first angle θ1 or a second angle θ2 and the illumination effect can be changed. In an embodiment, the first reflective sheet 122 and the second reflective sheet 124 can be rotated with respect to the shaft 121 in the same direction, so that the first reflective sheet 122 and the second reflective sheet 124 can tilt to a predetermined angle with respect to the lamp 110.

In an embodiment, the first angle θ1 or the second angle θ2 formed by the first reflective sheet 122 and the second reflective sheet 124 is less than 180°. For example, the first angle θ1 or the second angle θ2 is equivalent to 150°, 130° or smaller.

In another embodiment, the first reflective sheet 122 and the second reflective sheet 124 can respectively be rotated for a predetermined angle with respect to the shaft 121. For example, the first reflective sheet 122 is rotated for an angle with respect to the shaft 121 to adjust the lighting pattern formed by the light L reflected via the first reflective sheet 122; the second reflective sheet 124 is inversely rotated for another angle with respect to the shaft 121 to adjust the lighting pattern formed by the light L reflected via the second reflective sheet 124.

Figure 6A:
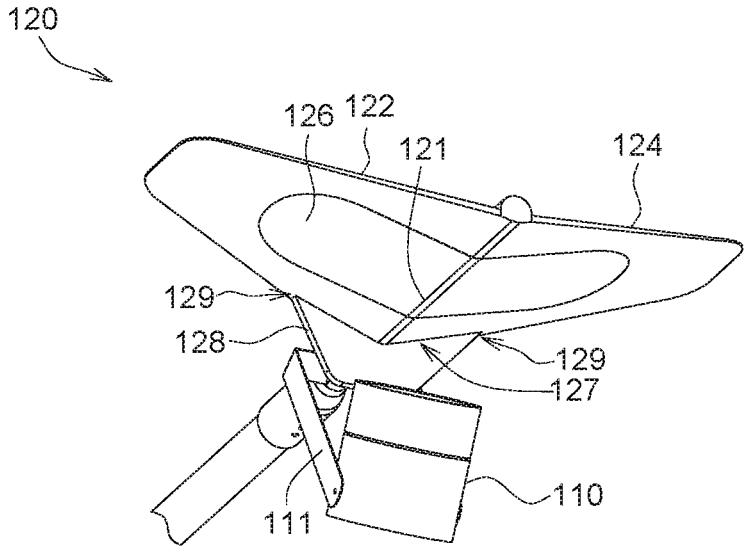
FIG. 6A is a schematic diagram of a lighting device according to an embodiment of the invention, wherein the reflector further includes a light shielding element.

Refer to FIG. 6A. The reflector 120 of the lighting device 100 according to an embodiment of the invention further includes a light shielding element 128 located in a side direction 127 corresponding to the rear of the reflector 120 for shielding a side light of the lamp 110 projected to the side direction 127 at the rear of the reflector 120. That is, the lighting device 100 provides the first reflective sheet 122 and the second reflective sheet 124 located in the light emitting direction of the lamp 110 and disposed farther away from the lamp 110, so that the light L is reflected via the first reflective sheet 122 and the second reflective sheet 124 to be irradiated on the areas corresponding to the two sides of the lamp 110, and a part of the side light is irradiated on the area corresponding to the front area of the lamp 110. Since the rear area of the reflector 120 and the lamp 110 normally is not used as roads, sidewalks or any areas requiring illumination, the rear area is shielded by the light shielding element 128, so that light pollution can be reduced and the illumination effect can be changed.

The light shielding element 128 is located under the first reflective sheet 122 and the second reflective sheet 124. The light shielding element 128 has a butterfly shape, and each wing of the butterfly shape has a tip 129 facing upward. The two wings of the light shielding element 128 are respectively connected to the first reflective sheet 122 and the second reflective sheet 124 and match the shapes of the first reflective sheet 122 and the second reflective sheet 124. The light shielding element 128 can be formed by a material with low reflectivity, a dark colored material or a light absorbent material.

Figure 6B:
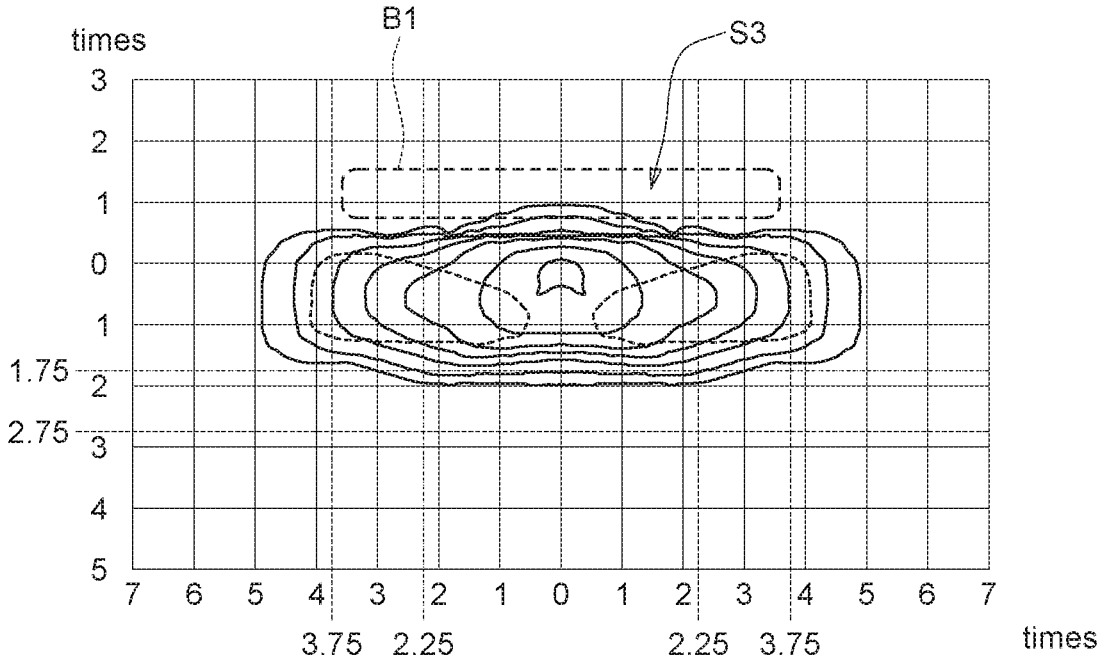
FIG. 6B is a contour diagram of a lighting pattern of the lighting device of FIG. 6A.

Referring to FIG. 6B, a contour diagram of a lighting pattern S3 of the lighting device equipped with a light shielding element 128 is shown. In the present embodiment, the side direction 127 of the lighting device 100 is shielded by the light shielding element 128, so that the light cannot reach the corresponding area of FIG. 6B (dotted square box B1), and the light pollution can be reduced.

The lighting device disclosed in above embodiments of the invention includes a reflector whose surface has a coating partially formed on the reflector according to the illumination conditions. The coating can adjust the lighting pattern of the lamp according to the road conditions to meet market needs. Meanwhile, the lighting device of the present embodiment can adjust the lighting pattern without using optical elements, hence saving the mold cost for the optical elements and reducing the manufacturing cost. Besides, the lighting pattern formed by the light reflected from the coating area can be more diversified through the design of different installation angles of the reflective sheet and/or the collaboration of the light shielding element.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lighting device, comprising:

a lamp; and a reflector located in a light emitting direction of the lamp and disposed distant from the lamp for reflecting a light emitted from the lamp, wherein the reflector comprises at least one reflective sheet and a coating partially formed on the at least one reflective sheet, wherein the coating has a shape, and the light is reflected by the coating to form a lighting pattern corresponding to the shape.

2. The lighting device according to claim 1, wherein the coating is formed by a reflective material, and the at least one reflective sheet has a reflectivity smaller or larger than a reflectivity of the coating.

3. The lighting device according to claim 1, wherein the light-emitting surface of the lamp faces upward and is located under the reflector, the lamp provides a tapered light source with a tapered lighting pattern to the coating of the reflector, and a coating area of the coating is within an irradiation area of the tapered light source.

4. The lighting device according to claim 3, wherein the irradiation area substantially corresponds to a light-emitting angle of the light source.

5. The lighting device according to claim 1, wherein the reflector further comprises a shaft on which the at least one reflective sheet is rotatably disposed.

6. The lighting device according to claim 1, wherein the at least one reflective sheet comprises a first reflective sheet, a second reflective sheet, and a shaft on which the first reflective sheet and the second reflective sheet are rotatably disposed.

7. The lighting device according to claim 6, wherein the first reflective sheet and the second reflective sheet are respectively rotated for a predetermined angle with respect to the shaft.

8. The lighting device according to claim 6, wherein the coating is located on a combination of the first reflective sheet and the second reflective sheet.

9. The lighting device according to claim 1, wherein the reflector further comprises a light shielding element located in a side direction of the reflector for shielding a side light projected to the side direction of the reflector by the lamp.

10. The lighting device according to claim 9, wherein the light shielding element has a butterfly shape having two tips facing upward, and two wings of the light shielding element are respectively connected to a first reflective sheet and a second reflective sheet of the reflector and match the shapes of the first reflective sheet and the second reflective sheet, the light shielding element is formed by a material with low reflectivity, a dark colored material or a light absorbent material.

11. The lighting device according to claim 1, further comprising a supporting member, wherein the reflector and the lamp are disposed on the supporting member.

12. The lighting device according to claim 11, further comprising a frame disposed on the supporting member and pivotally connected to the lamp.

13. The lighting device according to claim 1, wherein the reflector is wing-shaped.

14. The lighting device according to claim 1, wherein the reflector has a curved surface or a bevel for reflecting the light.

15. The lighting device according to claim 1, wherein the shape includes a long strip or a widened long strip.

16. The lighting device according to claim 1, wherein 50% of the light intensity of the lamp is within 1.75 times of an installation height of the lamp along a vertical axis to generate an elliptical lighting pattern.

17. The lighting device according to claim 1, wherein 50% of the light intensity of the lamp is within 1.75-2.75 times of an installation height of the lamp along a vertical axis to generate an elliptical lighting pattern.

18. The lighting device according to claim 1, wherein the coating is formed by a white lacquer, a non-white lacquer or a multi-color lacquer.

* * * * *